US007973721B2

(12) United States Patent
Rahm

(10) Patent No.: US 7,973,721 B2
(45) Date of Patent: Jul. 5, 2011

(54) MECHANICALLY INTEGRATED CABLE MESH ANTENNA SYSTEM

(75) Inventor: James K. Rahm, Allentown, PA (US)

(73) Assignee: General Instrument Corporation, Horsham, PA (US)

( * ) Notice: Subject to any disclaimer, the term of this patent is extended or adjusted under 35 U.S.C. 154(b) by 379 days.

(21) Appl. No.: 11/734,494

(22) Filed: Apr. 12, 2007

(65) Prior Publication Data

US 2008/0252547 A1 Oct. 16, 2008

(51) Int. Cl.
*H01Q 1/48* (2006.01)
*H01Q 21/00* (2006.01)

(52) U.S. Cl. ..... 343/702; 343/846; 343/893

(58) Field of Classification Search ..... 343/853, 343/846, 702, 700 MS, 872, 873, 878, 879, 343/890, 874, 893; 361/709, 714, 688; 165/80.3; 174/50, 50.54

See application file for complete search history.

(56) References Cited

U.S. PATENT DOCUMENTS

| | | | | |
|---|---|---|---|---|
| 5,030,961 | A * | 7/1991 | Tsao | 343/700 MS |
| 5,892,481 | A * | 4/1999 | Andersson | 343/700 MS |
| 5,898,412 | A * | 4/1999 | Jones et al. | 343/872 |
| 5,986,618 | A * | 11/1999 | Aakula et al. | 343/872 |
| 6,067,053 | A * | 5/2000 | Runyon et al. | 343/797 |
| 7,136,017 | B2 * | 11/2006 | Condon et al. | 343/700 MS |
| 7,369,098 | B2 * | 5/2008 | Chen | 343/893 |

* cited by examiner

*Primary Examiner* — Jacob Y Choi
*Assistant Examiner* — Robert Karacsony
(74) *Attorney, Agent, or Firm* — Larry T. Cullen

(57) ABSTRACT

Embodiments of the invention generally provide a mechanically integrated cable mesh antenna system. One embodiment of a wireless access device for a network includes a housing having at least one rib, beam forming electronics supported by the housing, and at least one antenna for providing subscribers of the network with a connection to the network, where the antenna is formed on the rib.

18 Claims, 3 Drawing Sheets

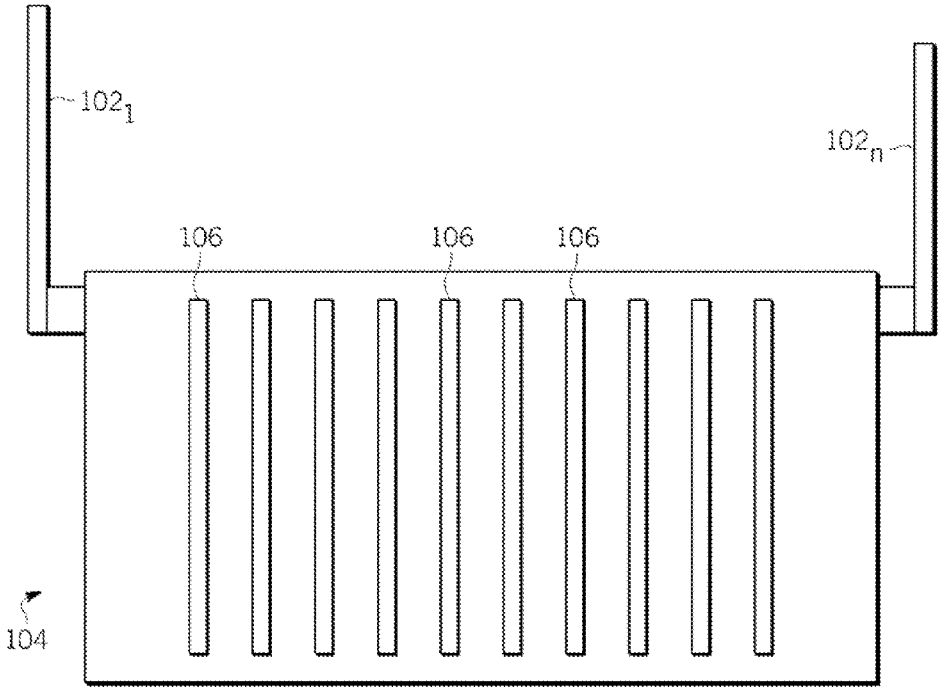
FIG. 1 100 Prior Art
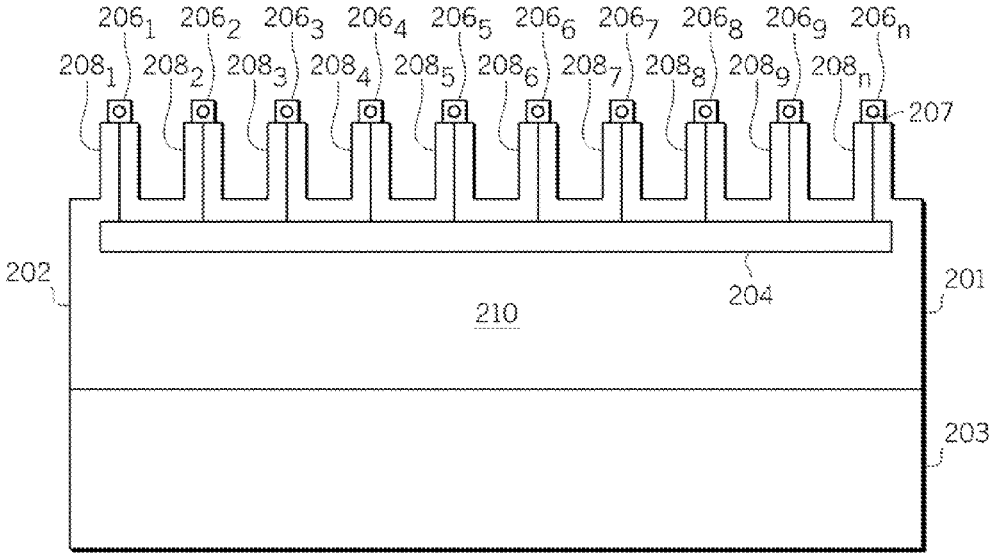
FIG. 2 200

500

600

MECHANICALLY INTEGRATED CABLE MESH ANTENNA SYSTEM

FIELD OF THE INVENTION

The present invention generally relates to cable broadband networks, and more particularly relates to cable mesh networks.

BACKGROUND OF THE INVENTION

Cable mesh is a relatively new type of high-capacity wireless broadband delivery system. A cable mesh network comprises a cable infrastructure (e.g., a hybrid fiber-coaxial or HFC infrastructure) and a one or more cable mesh nodes deployed at various locations and interfaced directly to the cable infrastructure.

FIG. 1 illustrates a typical cable mesh node 100. A cable mesh node such as the node 100 typically comprises a cable modem that connects to an HFC network and a Wi-Fi access point (AP) installed together in a common housing or enclosure. The AP includes an antenna for connecting to the cable mesh network and for providing network access to users. As illustrated in FIG. 1, currently, a typical cable mesh node employs bolt-on antenna elements $\mathbf{102}_1$-$\mathbf{102}_n$ (hereinafter collectively referred to as "antenna elements 102") that bolt to the housing 104 of the cable mesh node 100. The antenna elements 102 are separate from the housing 104, which encloses the beam forming electronics. As also illustrated, a typical housing 104 contains cooling fins 106 for thermal dissipation of heat.

Cable mesh nodes such as the node 100 are typically attached to elevated structures, such as poles, and are typically attached in areas of other utility services, such as high voltage electrical lines and public switched telephone network (PSTN) telephone lines. The operators of the cable mesh nodes must typically negotiate access rights for placement of the cable mesh nodes and generally are confined to a defined area. Currently, a technician must typically carry the housing of the cable mesh node up a ladder and mount the housing on the pole, for example. Then, the technician must typically also mount the antenna onto the housing (and the pole), which often requires a mechanical support rod to secure the antenna. Accordingly, the size and bulkiness of the AP often makes installation of a cable mesh node difficult, time consuming and potentially hazardous, due to the potentially close proximity to high voltage electrical lines.

Accordingly, there is a need in the art for a mechanically integrated antenna system for cable mesh networks.

SUMMARY OF THE INVENTION

Embodiments of the invention generally provide a mechanically integrated cable mesh antenna system. One embodiment of a wireless access device for a network includes a housing having at least one rib, beam forming electronics supported by the housing, and at least one antenna for providing subscribers of the network with a connection to the network, where the antenna is formed on the rib.

In another embodiment, a method for making a wireless access device for interfacing to a network, includes the steps of: providing a housing having at least one rib, housing beam forming electronics within the housing, and forming at least one antenna for providing subscribers of the network with a connection to the network on the rib.

BRIEF DESCRIPTION OF THE DRAWINGS

So that the manner in which the above recited embodiments of the invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

FIG. 1 illustrates a typical cable mesh node;

FIG. 2 is a side view of one embodiment of a cable mesh node, according to the present invention;

To facilitate understanding, identical reference numerals have been used, where possible, to designate identical elements that are common to the figures.

DETAILED DESCRIPTION

Embodiments of the invention provide a mechanically integrated cable mesh antenna system. In one embodiment, the electronics enclosure of a cable mesh node is used to contain the antenna elements in addition to the beam forming electronics. This reduces the size and improves the ruggedness of the cable mesh node.

Figure 3:
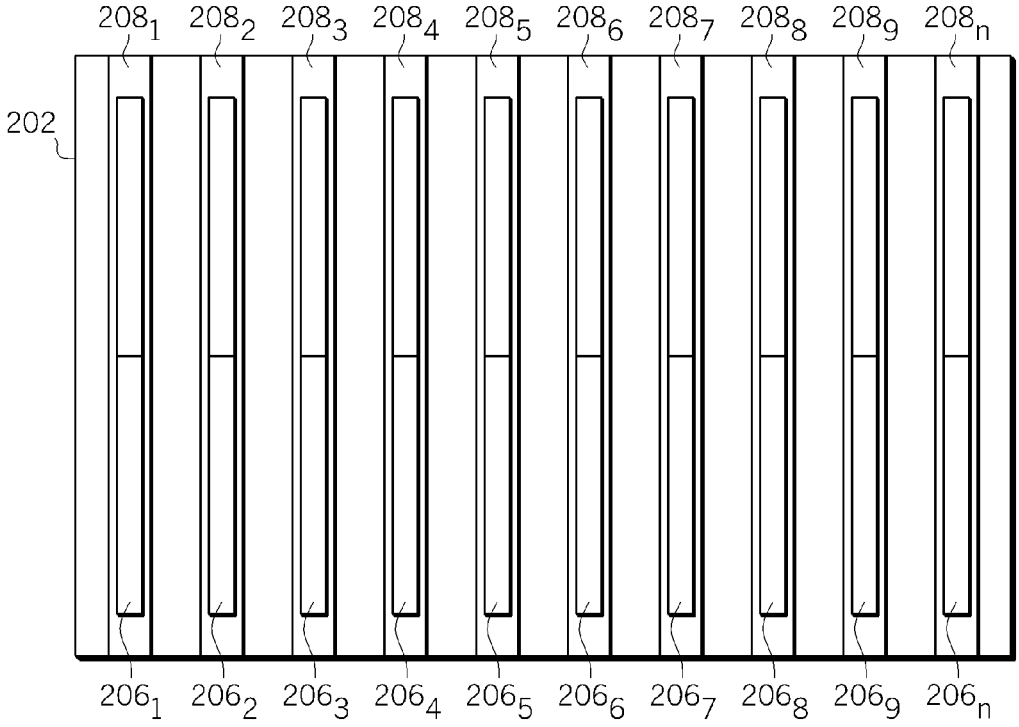
FIG. 3 is a plan view of the cable mesh node illustrated in FIG. 2.

FIG. 2 is a side view of one embodiment of a cable mesh node 200, according to the present invention. FIG. 3 is a plan view of the cable mesh node 200 illustrated in FIG. 2. Referring simultaneously to FIGS. 2 and 3, the cable mesh node 200 comprises a housing or electronics enclosure 202, beam forming electronics 204 and a plurality of radiating antenna elements $\mathbf{206}_1$-$\mathbf{206}_n$ (e.g., dipoles, microstrip lines or patches, or any other suitable antenna radiating elements, hereinafter collectively referred to as "antenna elements 206") integrated with the electronics enclosure 202, as described in further detail below.

In one embodiment, the electronics enclosure 202 contains an upper portion 201 and a lower portion 203, which, when placed together, define an interior volume 210 within which the beam forming electronics 204 are housed. In addition, the upper portion 201 further comprises a plurality of thermally dissipative ribs $\mathbf{208}_1$-$\mathbf{208}_n$ (hereinafter collectively referred to as "ribs 208") disposed on an exterior surface and integrally formed as part of the upper portion 201. For example, the upper portion 201 may be formed of a cast metal (e.g., aluminum), and the ribs 208 integrally formed with the casing in the casting of the metal. While the ribs 208 are only illustrated on the upper portion 201, those of skill in the art will appreciate that this illustration is only for discussion purposes and that the ribs 208 may be formed on the lower portion 203 or on both the upper portion 201 and the lower portion 203.

In one embodiment, the ribs 208 may also be used for dissipating heat from the beam forming electronics 204. The radiating antenna elements 206 are individually aligned to these ribs 208 (e.g., on a one-to-one basis) and suspended over the electronics enclosure 202, in one embodiment using dielectric spacers 207. While dielectric spacers are depicted, those of skill in the art will appreciate that any suitable electrical isolation material may be used to electrically isolate the antenna elements 206 from the ribs 208. The signals to be wirelessly transmitted may be provided to the antenna elements 206 by antenna element feeds (e.g., coaxial cable), which pass from the beam forming electronics 204 to the antenna elements 206 through the ribs 208. Those of skill in the art will also appreciate that a radome (not shown) may also be disposed over the antenna elements 206.

The cable mesh node 200 therefore integrates the antenna elements 206 with the electronics enclosure 202 by mounting the antenna elements 206 via the integrally formed ribs 208. The invention reduces the overall size and bulkiness of a cable mesh node, making installation of the cable mesh node much easier and potentially safer. The ruggedness of the cable mesh node 200 is also improved by integrating the antenna elements 206 with the electronics enclosure 202.

In addition, the electronics enclosure 202 under this configuration may also function as the antenna elements' ground plane and, if shaped appropriately, may further perform gain-pattern enhancement and beam shaping. For instance, it is known in the art that a radiating element or elements (e.g., antennae) appropriately spaced over a purposely designed curved or formed ground-plane (in this case, the electronics enclosure 202) can provide antenna pattern optimization not limited to more directivity to a location or improved sidelobes. For example, these advantages may be realized in configurations where either a single-element antenna (e.g., wherein the electronics enclosure 202 is ridged and in the form of a dish) or an array of antennae (e.g., where each antenna element is installed in a calculated position) are disposed on the electronics enclosure 202 to provide steerable patterns.

Figure 4:
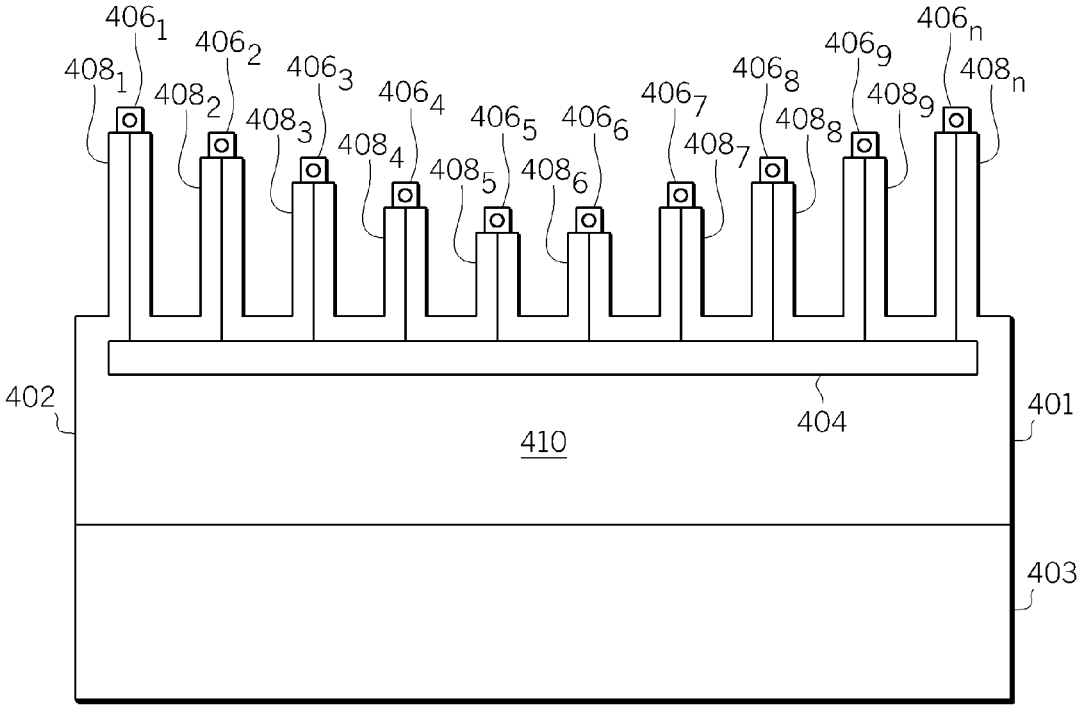
FIG. 4 is a side view of a second embodiment of a cable mesh node, according to the present invention.

FIG. 4 is a side view of a second embodiment of a cable mesh node 400, according to the present invention. Like the cable mesh node 200 illustrated in FIGS. 2-3, the cable mesh node 400 comprises a housing or electronics enclosure 402, beam forming electronics 404 disposed within an interior volume 410 defined by upper and lower portions 401 and 403 of the electronics enclosure 402 and a plurality of radiating antenna elements $\mathbf{406}_1$-$\mathbf{406}_n$ (e.g., dipoles, microstrip lines or patches, or any other suitable antenna radiating elements, hereinafter collectively referred to as "antenna elements 406") individually mounted via a plurality of thermally dissipative metal ribs $\mathbf{408}_1$-$\mathbf{408}_n$ (hereinafter collectively referred to as "ribs 408") integrally formed on an exterior surface of the electronics enclosure 402. Unlike the ribs 208 illustrated in FIGS. 2-3, which have a substantially uniform height, the ribs 408 of the cable mesh node 400 differ in height such that a dish-like shape is formed on the exterior of the electronics enclosure 402. As illustrated, each antenna element 406 is installed in a calculated position, with known spacing and shaped geometry. As described above, this configuration allows the electronics enclosure 402 to function as the antenna elements' ground plane and to further perform gain-pattern enhancement and beam shaping.

Figure 5:
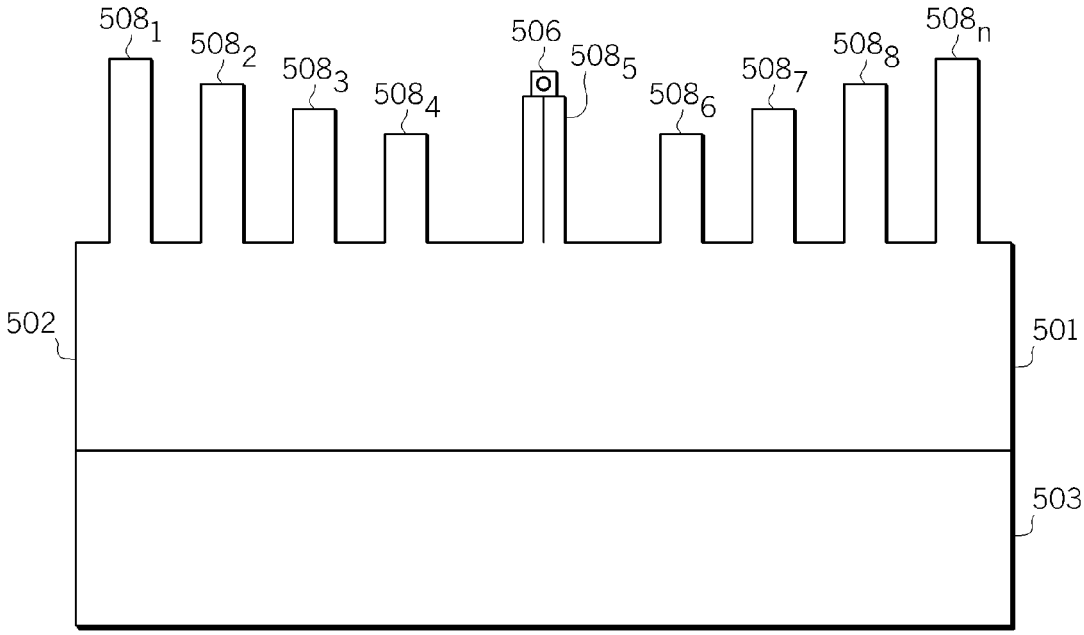
FIG. 5 is a side view of a third embodiment of a cable mesh node, according to the present invention.

FIG. 5 is a side view of a third embodiment of a cable mesh node 500, according to the present invention. The cable mesh node 500 comprises a housing or electronics enclosure 502 comprising upper and lower portions 501 and 503 and a single antenna element (e.g., dipole, microstrip line or patch, or any other suitable antenna radiating element) 506 mounted via one of a plurality of thermally dissipative metal ribs $\mathbf{508}_1$-$\mathbf{508}_n$ (hereinafter collectively referred to as "cribs 508") integrally formed on an exterior surface of the electronics enclosure 502. As illustrated, the ribs 508 of the cable mesh node 500 differ in height such that a dish-like shape is formed on the exterior of the electronics enclosure 502. As described above, this configuration allows the electronics enclosure 502 to function as the antenna element's ground plane and to further perform gain-pattern enhancement and beam shaping.

Figure 6:
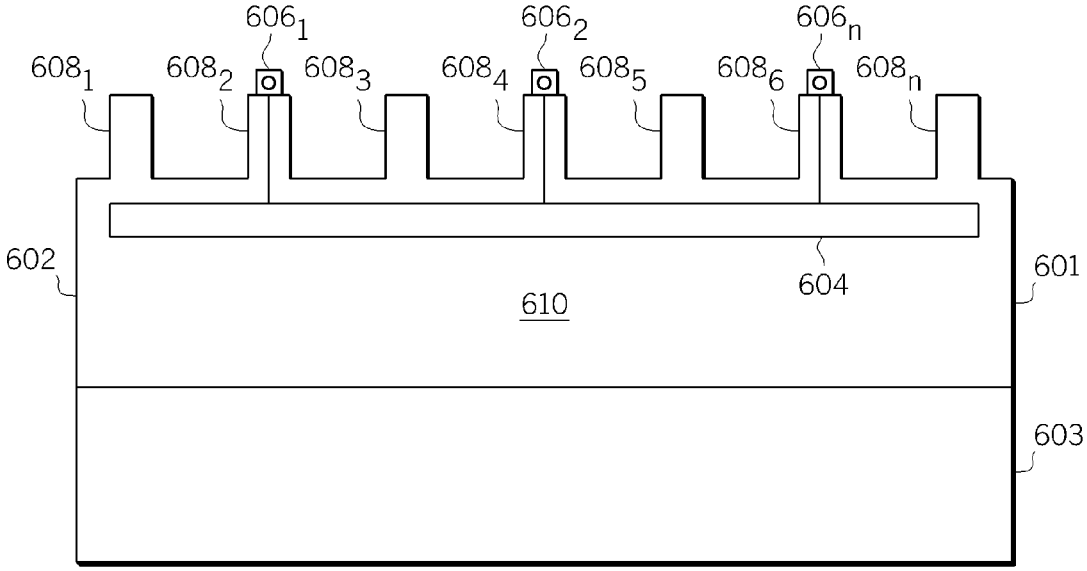
FIG. 6 is a side view of a fourth embodiment of a cable mesh node, according to the present invention.

FIG. 6 is a side view of a fourth embodiment of a cable mesh node 600, according to the present invention. Like the cable mesh node 200 illustrated in FIGS. 2-3, the cable mesh node 600 comprises a housing or electronics enclosure 602, beam forming electronics 604 disposed within an interior volume 610 defined by upper and lower portions 601 and 603 of the electronics enclosure 602 and a plurality of radiating antenna elements $\mathbf{606}_1$-$\mathbf{606}_n$ (e.g., dipoles, microstrip lines or patches, or any other suitable antenna radiating elements, hereinafter collectively referred to as "antenna elements 606") individually mounted via a plurality of thermally dissipative metal ribs $\mathbf{608}_1$-$\mathbf{608}_n$ (hereinafter collectively referred to as "ribs 608") integrally formed on an exterior surface of the electronics enclosure 602. Unlike the cable mesh node 200 illustrated in FIGS. 2-3, in which an antenna element is mounted to each rib, the cable mesh node 600 comprises an antenna element 606 mounted to every other rib 608. In one embodiment, this configuration includes an antenna element 606 mounted to a center rib $\mathbf{608}_3$. Those skilled in the art will appreciate that other configurations are possible in which only selected ribs 608 (as opposed to all ribs 608) include antenna elements 608 mounted thereto.

Thus, the present invention represents a significant advancement in the field of cable broadband networks. Embodiments of the invention generally provide a mechanically integrated cable mesh antenna system that reduces the size and weight and improves the ruggedness of a cable mesh node, allowing for easier installation of the cable mesh node. In addition, the novel configuration allows the electronics enclosure (including thermally dissipative metal ribs) of the cable mesh node to be deployed for beam shaping and forming.

While the foregoing is directed to embodiments of the invention, other and further embodiments of the invention may be devised without departing from the basic scope thereof.

What is claimed is:

1. A wireless access device for a network, the apparatus comprising:

a housing having a plurality of ribs;

beam forming electronics supported by the housing; and at least one antenna element(s) for providing subscribers of the network with a connection to the network, each of the at least one antenna element(s) being formed so as to have one surface wholly in contact with a portion of a surface of a unique one of the plurality of ribs, the surface of the unique one of the plurality of ribs being distal to the housing, wherein the plurality of ribs comprises a plurality of heat dissipating ribs formed on an exterior surface of the housing, for dissipating heat generated by the beam forming electronics.

2. The wireless access device of claim 1, wherein the beam forming electronics include a feed for providing electrical signals to be transmitted to the at least one antenna element(s) through at least one of the plurality of ribs.

3. The wireless access device of claim 1, wherein the plurality of heat dissipating ribs comprises ribs of a substantially uniform height.

4. The wireless access device of claim 1, wherein the plurality of heat dissipating ribs comprises ribs of varying heights.

5. The wireless access device of claim 4, wherein the plurality of heat dissipating ribs forms a dish shape on the exterior surface of the housing.

6. The wireless access device of claim 1, wherein each of the antenna elements comprises a dielectric spacer and a radiating element, and wherein each dielectric element is formed between each of the radiating elements and the surface of the one of the plurality of ribs on which each antenna element is formed.

7. The wireless access device of claim 1, wherein the at least one antenna element(s) form an array of antennae elements.

8. The wireless access device of claim 1, wherein the housing is configured to function as a ground plane for the at least one antenna element(s).

9. The wireless access device of claim 7, wherein the plurality of ribs are configured to provide at least one of: gain-pattern enhancement and beam shaping to the array of antennae elements.

10. The wireless access device according to claim 1, wherein a radiating element of each of the at least one antenna element is an electromagnetic radiating antenna element that is electrically coupled to the beam forming electronics.

11. The wireless access device according to claim 1, wherein the portion of the surface of the unique one of the plurality of ribs is a substantial portion.

12. The wireless access device according to claim 11, wherein the substantial portion is greater than 50%.

13. A method for making a wireless access device for interfacing to a network, comprising the steps of:

providing a housing having a plurality of ribs;

housing beam forming electronics within the housing; and forming at least one antenna element(s) for providing subscribers of the network with a connection to the network, each of the at least one antenna element(s) being formed so as to have one surface wholly in contact with a portion of a surface of a unique one of the plurality of ribs, the surface of the unique one of the plurality of ribs being distal to the housing, wherein the plurality of ribs comprises a plurality of heat dissipating ribs formed on an exterior surface of the housing, for dissipating heat generated by the beam forming electronics.

14. The method of to claim 13, further comprising:

providing a feed in the beam forming electronics for providing electrical signals to be transmitted to the at least one antenna element(s) through the one of the plurality of heat dissipating ribs.

15. The method according to claim 13, wherein each of the antenna elements comprises a dielectric spacer and a radiating element, further comprising forming the dielectric spacer between each of the radiating elements and the surface of the one of the plurality of ribs on which each antenna element is formed.

16. The method according to claim 14, wherein each of the antenna elements comprises a dielectric spacer and a radiating element, further comprising forming the dielectric spacer between each of the radiating elements and the surface of the one of the plurality of ribs on which each antenna element is formed.

17. A wireless access device for a network, the apparatus comprising:

a housing having a plurality of ribs;

beam forming electronics supported by the housing; and a plurality of radiating antenna element(s) for providing subscribers of the network with a connection to the network, wherein each of the plurality of radiating antenna element(s) is formed to be overlaid on a portion of a surface of one of the ribs that is distal from the housing, and wherein the body of each of the plurality of radiating antenna element(s) does not extend beyond the surface of the one of the ribs, and wherein the ribs are formed on an exterior surface of the housing and are heat conducting ribs thermally coupled to the beam forming electronics.

18. The wireless access device according to claim 17, further comprising a dielectric spacer formed between each of the radiating antenna elements and the portion of the surface of the one of the ribs that is distal from the housing.

* * * * *